United States Patent [19]

Hamer et al.

[11] Patent Number: 4,804,340

[45] Date of Patent: Feb. 14, 1989

[54] PLASTIC MOLDED TERMINAL BLOCK ASSEMBLY FOR A TRANSFORMER

[75] Inventors: William H. Hamer, Guelph; Harry H. Barber, Elora, both of Canada

[73] Assignee: Hammond Manufacturing Company Limited, Canada

[21] Appl. No.: 904,624

[22] Filed: Sep. 8, 1986

[51] Int. Cl.[4] ..... H01R 9/24

[52] U.S. Cl. ..... 439/709; 336/192; 336/198

[58] Field of Search ..... 439/709, 721, 722; 336/192, 198

[56] References Cited

U.S. PATENT DOCUMENTS

| | | | |
|---|---|---|---|
| 3,164,709 | 1/1965 | Gentile | 439/709 |
| 3,457,534 | 7/1969 | Davis | 336/192 |
| 3,516,040 | 6/1970 | Ripley et al. | 336/96 |
| 3,566,322 | 2/1971 | Horbach | 336/192 |
| 3,760,339 | 9/1973 | Marshall | 339/221 |
| 3,781,741 | 12/1973 | Weiner | 336/192 |
| 4,003,128 | 1/1977 | Dochterman | 336/192 |
| 4,027,279 | 5/1977 | Shigehara | 336/198 |
| 4,171,863 | 10/1979 | Perkins, Jr. | 339/263 |
| 4,238,753 | 12/1980 | Bayer | 336/198 |
| 4,273,408 | 6/1981 | Orr | 439/709 |
| 4,318,069 | 3/1982 | Morse | 336/192 |
| 4,423,399 | 12/1983 | Goodrich | 335/202 |
| 4,503,413 | 3/1985 | Stalzer | 336/192 |
| 4,602,235 | 7/1986 | Howard et al. | 336/192 |
| 4,630,882 | 12/1986 | Naylor et al. | 439/709 |

*Primary Examiner*—John McQuade

*Attorney, Agent, or Firm*—Stevens, Davis, Miller & Mosher

[57] ABSTRACT

A transformer terminal block molded from plastic is disclosed having a U-shaped skirt portion fitting in the gap between the coil and the core, to provide the required creepage distance at two adjacent corners of the coil, without the need for taping the corners. The described transformer has a new metallic terminal bay structure which facilitates the assembly of the transformer. The assembly is also facilitated by the described structure of the underside of the terminal base which simplifies the leading of magnetic wires from different windings, terminating on top of the coil, to the respective terminals. The invention presents a substantial simplification of the structure and manufacture of transformers having plastic molded terminal blocks.

24 Claims, 5 Drawing Sheets

FIG. 4
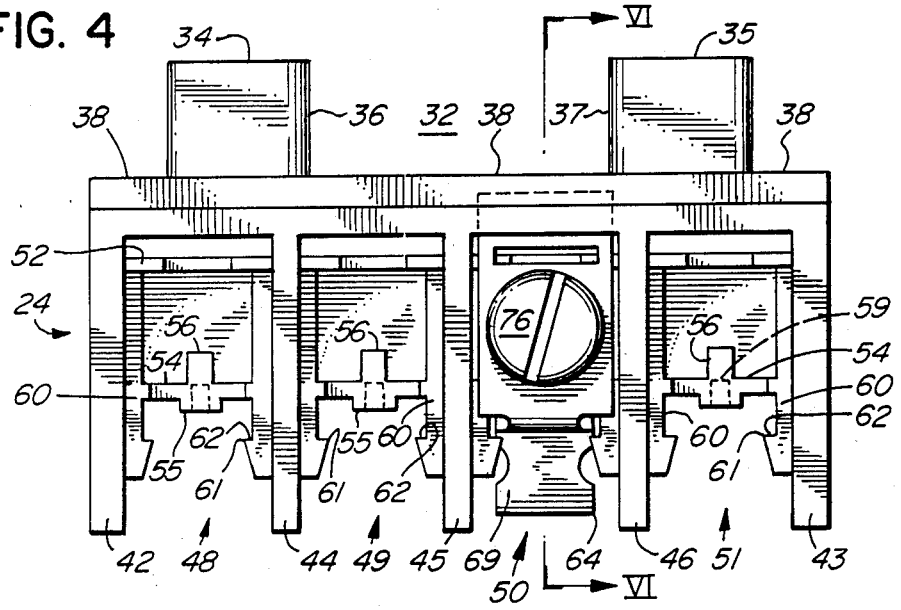
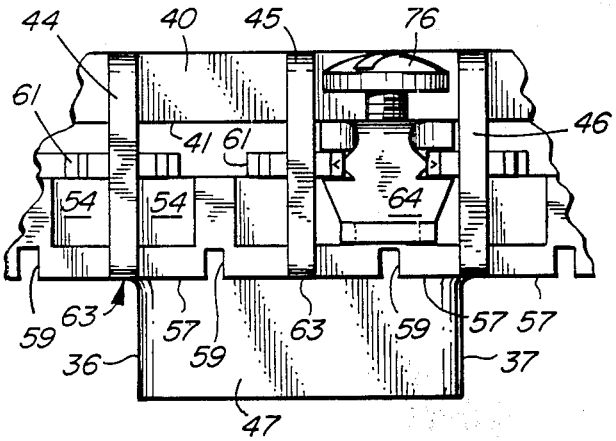
FIG. 5
FIG. 6
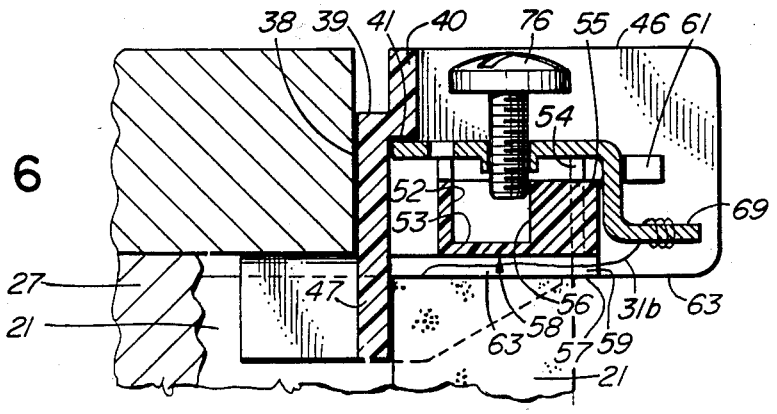

PLASTIC MOLDED TERMINAL BLOCK ASSEMBLY FOR A TRANSFORMER

BACKGROUND OF THE INVENTION

The present invention relates to transformers. One type of transformers to which the invention relates is shown in FIG. 1 of the accompanying drawings, wherein reference number 10 designates an "E"-shaped core element. The central part of the core element 10 passes through the central opening of a coil 11 resting on an insulating channel 12 which, in turn, rests on the E-shaped core element. Reference numeral 14 denotes an I-shaped member. The I-shaped member 14 is welded to the core element 10. Both the I-shaped member 14 and the core element 10 are made of iron laminations as is well known in the art. A typical arrangement of terminals of a transformer of prior art provides a plurality of metallic terminals 15, 16, 17, 18, etc. which are generally L-shaped and include each a horizontal plate portion with a clamping screw and a normally generally vertically directed portion to which is secured the end of a respective winding of the transformer coil. The securement of the windings to the terminals 15–18 and the mounting of the terminals to the coil itself is cumbersome and time consuming and thus expensive. Moreover, the terminals are inadequately supported physically and are exposed to mechanical damage and breakage. Also, they are prone to electrical shorting.

U.S. Pat. No. 3,516,040 issued June 2, 1970 to J. F. Ripley et al. presents an improvement wherein the horizontal plate sections of the terminals such as terminals 15–18 are embedded in a molded plastic support which is also provided with a number of partitions separating each terminal plate from the other. The metallic terminals of this arrangement are no longer exposed to mechanical damage. They are sufficiently insulated from each other and from the core of the transformer. However, the time consuming and thus expensive attaching of the metallic terminals to the transformer is still present. Also, the molding of the entire casing is expensive.

The object of the invention is to further advance the art of transformers by improving structural features of the terminal blocks and the terminals thereof which would retain the advantages of the arrangement as shown in Ripley et al. and would also very substantially facilitate the assembly of the transformer and in particular the securement of the metallic terminals to the transformer.

It is another object of the invention to provide such an arrangement of the terminal block, the coil and the core, which would provide the required creepage distance between the coil and the core at the corners thereof, without unduly increasing the manufacturing costs.

SUMMARY OF THE INVENTION

According to the present invention, and in one aspect thereof, a terminal block is provided for use in a transformer including a coil and a core extending through the coil, said block being molded from a plastic material and comprising a row of terminal receiving bays at a normally upper surface thereof, said block being provided with a normally downwardly dependent skirt portion integral with the block and protruding from a normally lower surface of the block, said skirt portion having a generally U-shaped configuration complementary with a gap between the coil and the core of an associated transformer, whereby, with the block being applied, the skirt portion can be inserted into the gap to provide a required creepage distance between the coil and the core.

In another aspect of the present invention, a terminal supporting block is provided molded from an insulating material, for use in a transformer to form a normally upper portion of the transformer structure said block being of the type forming at least one transverse row of terminal mounting bays, each bay being defined by two longitudinal, spaced apart and normally generally upright side walls and by a normally generally upright end wall extending between the side walls at the end of the respective bay, each bay being provided with terminal positioning and securement means, said positioning and securement means including, in combination, a support structure having normally upwardly facing supporting sections adapted to support a flat metallic terminal portion within the respective bay such as to prevent the metallic terminal portion from falling down through the bay, said support structure being formed by normally upper surfaces of a pair of locking blocks integral with and disposed one on each side wall; a normally generally downwardly facing securement structure spaced from a level of said support structure by a distance generally corresponding to the thickness of said flat metallic terminal portion such as to prevent a normally upward displacement of the flat metallic terminal portion when the respective metallic terminal is inserted in the respective bay, said securement structure being formed by an inversely and inwardly stepped portion of the end wall, said stepped portion being adapted to engage a normally upper face of an associated flat metallic terminal portion at a forwardmost part thereof; locking means formed by portions of the locking blocks and facing inwardly of the side walls of the bay for interference fit with a portion of the associated metallic terminal as the respective terminal is being inserted into the respective bay, to thus provide a temporary obstacle to a withdrawal of the terminal from the bay; and anchoring means, additional to said locking means, for firmly anchoring the respective terminal in the respective bay.

BRIEF DESCRIPTION OF THE DRAWINGS

The present invention will now be described with reference to the accompanying simplified, not to scale drawings in which:

FIG. 4 is a simplified top plan view of the terminal block of the shown transformer, with certain parts removed for the sake of clarity;

FIG. 5 a partial front view taken from the bottom of FIG. 4;

FIG. 6 is section VI—VI of FIG. 4 with certain parts added;

DETAILED DESCRIPTION OF A PREFERRED EMBODIMENT

Figure 1:
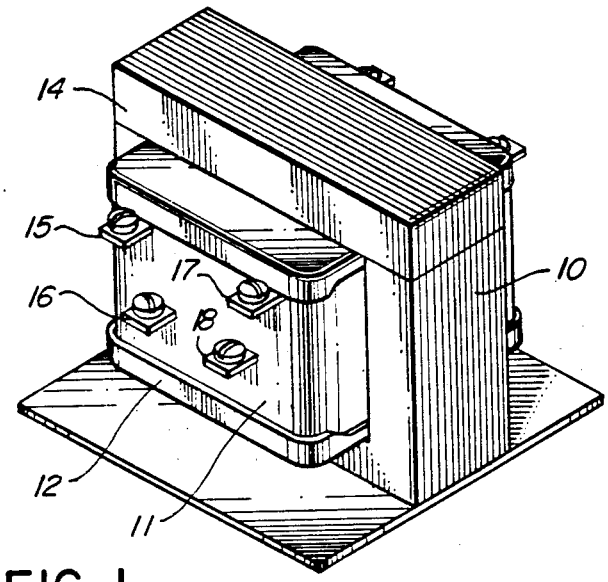
FIG. 1 PRIOR ART
FIG. 1 is a perspective view of a transformer provided with terminal structure of a known type.

The arrangement according to the present invention is diagrammatically shown in FIGS. 2–11. Briefly, the shown transformer contains a base plate 19 (also known in prior art and therefore shown in FIG. 1) to which is secured an E-shaped laminated core element 20 the central part of which protrudes through a coil 21 of a transformer. The bottom part of the coil rests on a pair of identical plastic bottom cups or channels 22 while the top of the coil 21 is enclosed by a pair of terminal blocks 23, 24 made of molded insulating plastic material. A tape 25, 26 of insulating material is wound on the opposed sides of the coil 21 to provide insulation between the coil 21 and the core element 20 of the transformer, particularly between the inner core portion 27 and the coil 21. It should be noted that the tapes 25, 26 are wound only about straight portions of the coil 21 and do not have to extend to the corners as the insulation between the inner core portion 27 and the coil 21 is secured by one of the features of the invention described later. The core element 20 is welded to a laminated I-shaped member 28. It will be seen that the base plate 19, the core element 20, the coil 21 and the I-shaped member 28 are virtually indentical with their counterparts of prior art transformer of FIG. 1.

Figure 2:
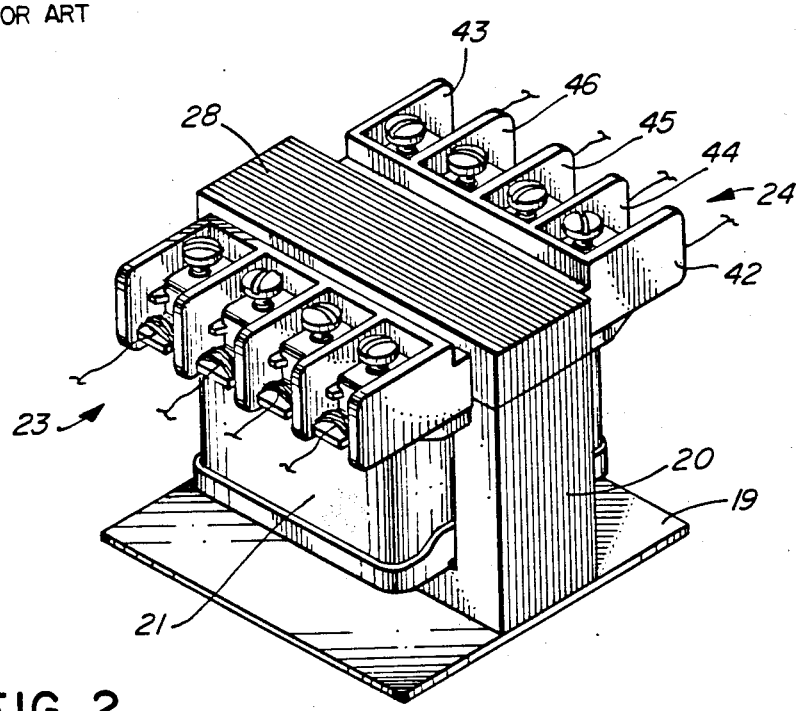
FIG. 2 is a perspective view of a transformer showing the present invention in its preferred embodiment.
Figure 3:
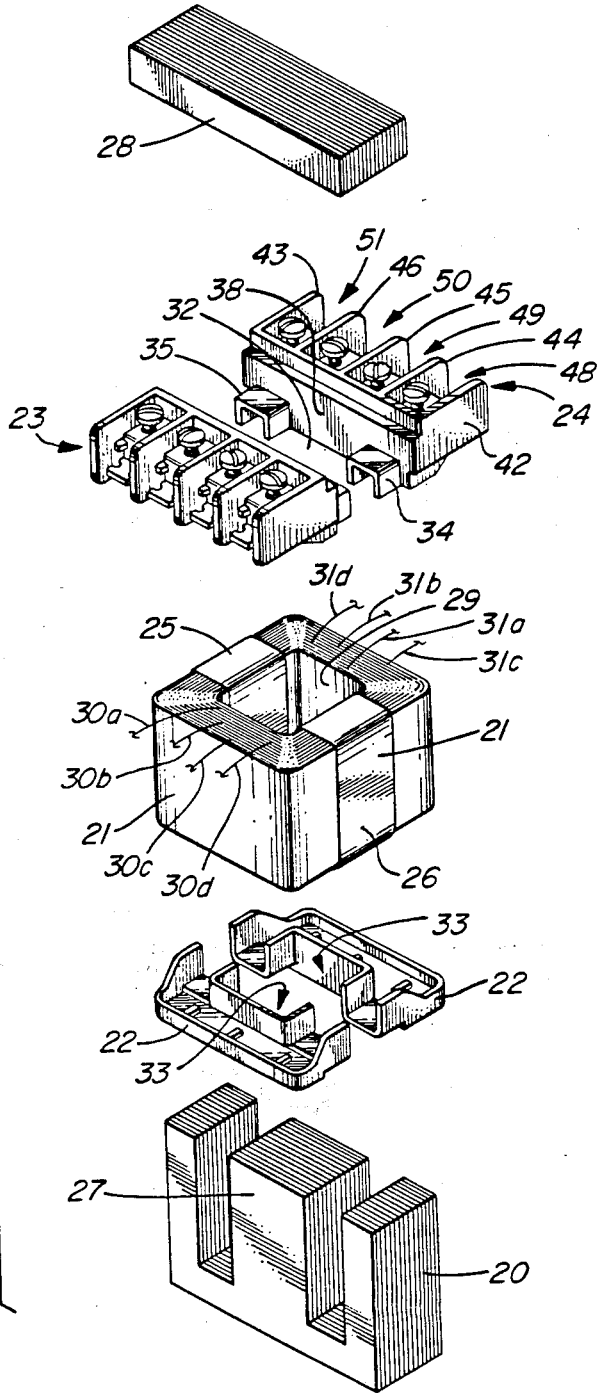
FIG. 3 is a simplified exploded view of the assembly as shown in FIG. 2 with the base, included in FIG. 2, removed.

The way of assembling of the elements of the transformer of FIG. 2 is apparent from in FIG. 3, in which the base plate 19 is omitted, it being understood that it would be eventually affixed to the transformer assembly. Briefly, the core element 20 first receives the pair of generally U-shaped bottom cups 22 on which is then seated the coil 21 the central part of which defines an opening 29 which receives the inner core portion 27 of the core element 20. Reference numerals 30*a*, 30*b*, 30*c*, 30*d*, 31*a*, 31*b*, 31*c* and 31*d* designate ends of different windings of the coil 21. The terminal blocks 23, 24 will be described in greater detail later. It will suffice to say at this point that each block 23, 24 defines a U-shaped opening such as opening 32 which, on assembly, is generally coincident with the corresponding opening 33 of the respective cup 22, with the corresponding part of the opening 29 of the coil 21 and with the central part 27 of the core element 20, all elements being viewed in plan. After the foregoing elements have been assembled, the I-shaped member 28 is welded to the core element 20.

Figure 11:
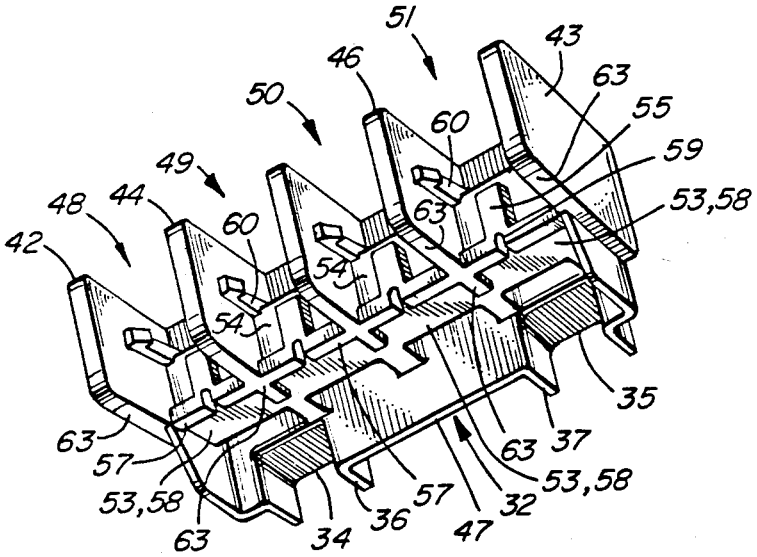
FIG. 11 is a bottom and front perspective view of the terminal block of FIG. 10.

The terminal blocks 23, 24 are of identical configuration. As best seen from FIG. 4 and FIG. 11, the terminal block 24 is provided with two channel protrusions 34, 35. one at each side of the block, whose downwardly dependent inner walls 36, 37 form opposed sides of the U-shaped opening 32. The inner walls 36, 37, the underside of the block and their associated outer walls thus form, at each side of the block, a downwardly open channel of an inverted U-shaped cross-section (FIG. 11). The inner walls 36, 37 also form a part of a skirt portion which will be referred to later. The channel protrusions extend from an end wall 38. The structure of the end wall 38 is best seen from the cross-sectional representation in FIG. 6 which shows the arrangement in somewhat greater detail. It shows that end wall 38 terminates at its top by a narrow ledge 39 which forms a transition between the wall 38 and an upper wall section 40. The upright wall section 40 combines with the ledge 39 to define a downwardly facing lower surface 41. A pair of side walls 42, 43 and partitions 44, 45, 46 integral with the upper wall section 40 to divide the terminal block of FIG. 4 into four terminal bays properly insulated from each other by the partitions and, from the core passing through the opening 28, by the end wall 38, the aforesaid downwardly directed skirt portion formed by a transverse panel 47 and by the inner walls 36, 37.

It should be mentioned at this point that when the block is completely assembled, each of the terminal bays 48, 49, 50 and 51 is of an identical structural arrangement indicated in FIG. 3, even though the bays shown in FIG. 4 have certain parts thereof removed for the sake of clarity. Each of the bays of the left-hand side terminal block 23 of FIG. 3, which are not referred to with any reference numerals, is of a structural configuration identical with that of the bay 50 shown in FIGS. 4, 5 and 6, when the transformer is finished.

Turning now in particular to the representation of the bay 50 in FIG. 4 and to the cross-sectional representation of FIG. 6, it can be seen that each bay further includes a generally U-shaped transverse structure which is comprised of an inner upright wall section 52 (also referred to as a ¢transverse rear wall") merging, at the bottom, with a bottom wall section 53 which, in turn, merges with an outer upright wall section 54 (also referred to as a ¢front wall"). Since the structure of each bays 48–51 is identical, the same reference numbers are used for the corresponding parts regardless of the bay in which they appear. As best seen from FIG. 4, the outer upright wall section 54 is integral at its outwardly directed face with a spacer section 55 and, at its inwardly directed face, with a boss 56. It will be appreciated on review of the arrangement of FIG. 6 vis-a-vis FIG. 4 that the elements thus far described relate only to those shown in each bay 48–51 of FIG. 4, while the cross-sectional representation of bay 50 in FIG. 6 includes additional elements.

Figure 10:
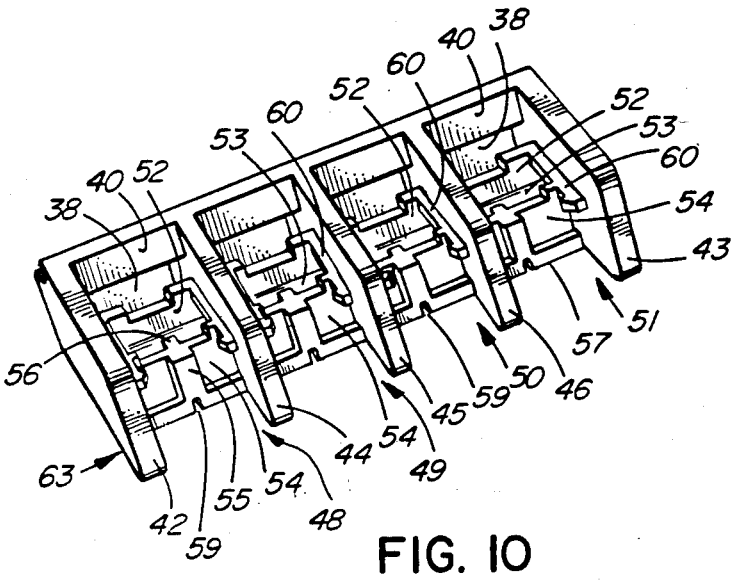
FIG. 10 is a top and front perspective view of a terminal block according to one aspect of the present invention.

Turning to FIG. 6 and FIG. 11 and referring to the outer upright wall section 54, it will be seen that it protrudes, by way of a downwardly directed outer rib 57, below the level of the downwardly turned surface 58 of the bottom wall section 53. FIGS. 5, 10 and 11 show that the rib 57 is provided with a downwardly opening slot 59 for the purpose to be explained later.

Each side wall 42, 43 and partition 44, 45, 46 is provided, inwardly of the respective bay 48–51, with an inwardly protruding guide section 60. The length of the guide section 60 extends from the respective inner upright wall section 52 outwardly to a point well beyond the outer upright wall section 54, as best seen from FIG. 4. The outermost part of each guide section 60 is provided, at a point beyond the outer upright wall section 54, with wedge-shaped locking blocks 61 each defining a forward facing locking notch 62.

It is clearly seen from the representation of FIGS. 5, 6, 10 and 11 that the top edges of the side and partition walls 42–46 are coplanar with the top edge of the upright wall section 40, while the lowermost edges 63 of the side walls and partitions are slightly below the level of the downwardly turned surface 58 of the bottom wall section 53.

Figure 7:
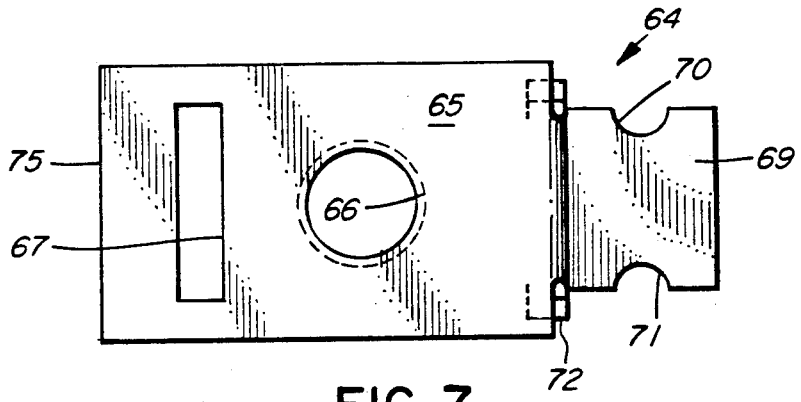
FIG. 7 is a top plan view of a metallic terminal according to the present invention.

The bay 50 is shown, in FIGS. 4, 5 and 6, as including a metallic terminal 64 which provides one aspect of the invention and will now be described in greater detail, with reference to FIGS. 7, 8 and 9.

Figure 8:
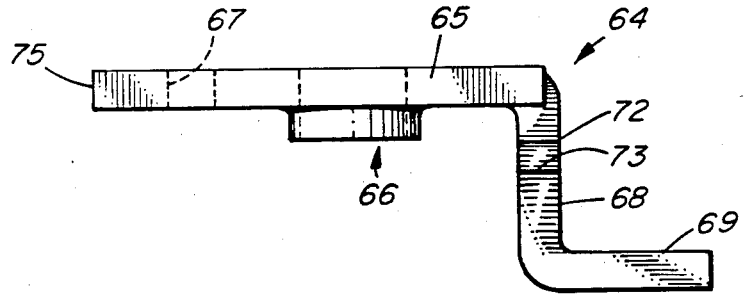
FIG. 8 is a side view thereof.
Figure 9:
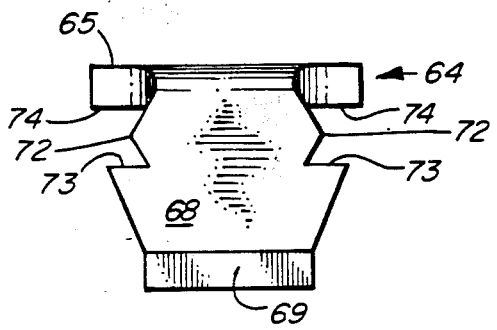
FIG. 9 is a front view thereof, taken from the right hand side of FIG. 8.

The metallic terminal of the present invention has a generally Z-shaped configuration apparent from FIG. 8 and including an upper, normally generally horizontal plate portion 65 is provided with a threaded or ready to be tapped opening 66. One end of the plate portion 65 is provided with a varnish drainage opening 67. The other end merges with a downwardly directed stem portion 68 connecting the plate portion 65 to a normally horizontal necked portion 69 having a pair of rounded cutouts 70, 71.

The stem portion 68 is provided with certain features of the present invention to be read in conjunction with structural elements of the bays 48–51 referred to above. As best seen from the end view of FIG. 9 and also from FIG. 5, the stem portion 64 has a contour including two obtuse-angled sharp points 72 at opposed sides of the stem 68. Just below the points 72, a guide ledge portion 73 (FIG. 9) is provided at a predetermined spacing from the underside 74 of the plate portion 65.

It is a feature of the present invention that the distance between the points 72 is only slightly in excess of the minimum distance between the respective pair of opposed locking blocks 61 at the notches 62. Furthermore, the spacing between the ledge 73 and the underside 74 is such as to provide a sliding and guiding engagement between the ledge 73 and the underside 74 on the one hand, and the guide section the locking block 61 on the other.

The metallic terminal 64 as described above, devoid of a clamping screw, is preliminarily secured to the respective terminal bay such that its plate portion 65 is first generally aligned with the top of the upright wall sections 52 and 54 and with the top of the guide section 60 (which is coplanar with the former two). Then, the terminal is pushed inwards until its leading end 75 abuts against the end wall 38 below the downwardly facing lower surface 41 as best seen in FIG. 6. As the terminal is being pushed to its position shown in FIG. 6, the points 73, being forced by the locking block 61, scratch each a tin groove in each of the respective two inwardly convergent surfaces of the locking blocks 61. When the points 72 get inwardly beyond the locking notches 62, inadvertent release of the metallic terminal 64 from the respective bay 50 (e.g. during a subsequent conveying to the next assembly operation) is virtually impossible. The placement of the terminal 64 within the bay is eventually finalized by threading through the opening 66 (possibly preceded by tapping) a clamping screw 76 which rests against the boss 56 thus preventing withdrawal of the terminal 64 to the right of FIG. 6. A displacement of the terminal inwardly of the respective bay, i.e. to the left of FIG. 6, is prevented by the spacer section 55 which is now engaged by the stem portion 68.

It can be seen from the above that one of the features of the invention provides for an extremely simple and inexpensive assembly of the metallic terminals in a bay of the terminal block as described.

In assembling a transformer, the metallic terminals 64 are first pressed into the respective bays such as bays 48–51. This assembly is then added to previously wound coil 21 of one or more windings including, for each winding, a magnet wire such as magnet wires **30*a*–31*d*, each used as a lead. Owing to the number of protrusions formed by extensions of the lowermost edges 63 beyond the transverse, downwardly directed outer ribs 57, (see FIG. 11) there is formed underneath the bays 48–51 a coil face covering section limited by the panel 47, and formed by the downwardly facing surfaces 58 of the bottom wall sections 53. The thickness of the inner walls 36, 37 and of the panel 47 is so selected that the skirt section snugly fit into the space between the opening 29 of the coil and the adjacent surface of the inner core portion 27 and provide the required creepage distance between the coil 21 and the core 27 at the critical points of corners of the two, without the need for laborious and thus costly taping of the corners. The extensions of the lowermost edges 63 form in effect spacer protrustions keeping the surface 58 spaced from the top surface of the coil 21. It is a simple matter to arrange the magnetic wires 30*a*–31*d* in a pattern suitable for passage of the wires 30*a*–31*d* through the corresponding slots 59 and then to the necked portion 69 of the associated terminal 64**.

As an example, the wire 31b and each remaining wire is arranged to project through the respective slot 59 provided in the rib 57. Each magnet wire **30*a*–31*d* is then wrapped around the necked portion 69 of the respective terminal and soldered or welded to same. The narrow slots 59 enable the subsequent varnish impregnation to cement the fine magnet wires into the slots thus holding them in place to prevent damage during handling of the finished transformer. The lower cups 22 are then assembled to the coil and the iron core element 20 is inserted through the insulators and the coil. The I-lamination 28 is then placed in position and welded to the core element 20. It engages the top surfaces of the channel protrusions 34, 35 to fix the terminal blocks in position. Then the base plate 19 is added and welded on and the metal terminals masked to prevent coating with varnish. Furthermore, the drainage opening 67 in the metallic terminal allows the excess varnish from impregnation to drain out of the terminal bay so that it will not interfere with the insertion of the clamping screw 76. The complete transformer is then immersed in, and vacuum impregnated with varnish. This coats and seals the coil to moisture and contaminants and coats the steel core base and moldings. The coating protects the steel parts from corrosion due to moisture, etc. Eventually, the masking is stripped off the terminals, the terminals are tapped and the clamping screws 76** inserted.

The invention significantly simplifies the production of transformers having molded upper blocks provided with bays mechanically and electrically protecting each terminal. It also provides simple and thus inexpensive means for assuring the required creepage distance between the core and the coil at the corners thereof.

We claim:

1. A terminal block for use in a transformer including a coil and a core extending through the coil, said block being molded from a plastic material and comprising a row of terminal receiving bays at a normally upper surface thereof, said block being provided with a normally downwardly dependent skirt portion integral with the block and protruding from a normally lower surface of the block, said skirt portion having a generally U-shaped configuration complementary with a gap between the coil and the core of an associated transformer, whereby, with the block being applied, the skirt portion can be inserted into the gap to provide a required creepage distance between the coil and the core.

2. A terminal block as claimed in claim 1, wherein a part of said skirt portion forms an inner side wall of a generally U-shaped, normally downwardly open channel at each side of the block and in an underside thereof, said channel further including, at each side of the block, an outer wall defining, with at least a part of said skirt portion, the width of said channel.

3. A terminal block as claimed in claim 2, wherein the width of said channel is generally equal to the thickness of the associated coil.

4. A terminal block as claimed in claim 2, wherein said skirt portion includes a transverse panel located along the row of the bays, and an outer rib protruding from an underside of the bays, the outer rib being parallel with and spaced from the transverse panel and being provided with a downwardly open groove under each of said bays, for an associated wire to pass from said coil to one of said bays.

5. A terminal block as claimed in claim 2, further comprising a plurality of spacer protrusions protruding from the underside of the bays to maintain the underside of the bays spaced from a respective normally upper face of an associated coil to facilitate the passage of winding wires to the respective bays.

6. A transformer comprising:

a coil having a generally rectangular plan, a core disposed in the coil and having a generally rectangular cross-section, and a pair of opposed terminal blocks molded from insulating plastic and secured to the normally upper face of the coil to thus provide two generally parallel and opposed rows of terminal receiving bays, each block being provided with a normally downwardly dependent skirt portion integral with the respective block and having a generally U-shaped configuration complementary with a gap between the coil and the core, the skirt portion being inserted in the gap between the coil and the core to provide a required creepage distance between the coil and the core.

7. A transformer as claimed in claim 6, wherein a part of said skirt portion forms an inner side wall of a generally U-shaped, downwardly open channel at each side of the block and in an underside thereof, said channel further including, at each side of the block, an outer wall defining, with at least a part of said skirt portion, the width of said channel.

8. A transformer as claimed in claim 7, wherein the width of said channel is generally equal to the thickness of the coil.

9. A transformer as claimed in claim 7, wherein said skirt portion includes a transverse panel located along the row of the bays, and an outer rib protruding from an underside of the bays, the outer rib being parallel with and spaced from the transverse panel and being provided with a normally downwardly open groove under each of said bays, an associated wire passing through the groove from a winding of the coil to an associated bay and to a metallic terminal disposed therein.

10. A transformer as claimed in claim 7 further comprising a plurality of spacer protrusions extending from the underside of the bays and engaging a normally upper face of the coil to keep the underside of the bays at a spacing from said upper face of the coil.

11. A terminal supporting block molded from an insulating material, for use in a transformer to form a normally upper portion of the transformer structure said block being of the type forming at least one transverse row of terminal mounting bays, each bay being defined by two longitudinal, spaced apart and normally generally upright side walls and by a normally generally upright end wall extending between the side walls at the end of the respective bay, each bay being provided with terminal positioning and securement means, said positioning and securement means including, in combination:

(a) a support structure having normally upwardly facing supporting sections adapted to support a flat metallic terminal portion within the respective bay such as to prevent the metallic terminal portion from falling down through the bay, said support structure being formed by normally upper surfaces of a pair of locking blocks integral with and disposed one on each side wall;

(b) a normally generally downwardly facing securement structure spaced from a level of said support structure by a distance generally corresponding to the thickness of said flat metallic terminal portion such as to prevent a normally upward displacement of the flat metallic terminal portion when the respective metallic terminal is inserted in the respective bay, said securement structure being formed by an inversely and inwardly stepped portion of the end wall, said stepped portion being adapted to engage a normally upper face of an associated flat metallic terminal portion at a forwardmost part thereof;

(c) locking means formed by portions of the locking blocks and facing inwardly of the side walls of the bay for interference fit with a portion of the associated metallic terminal as the respective terminal is being inserted into the respective bay, to thus provide a temporary obstacle to a withdrawal of the terminal from the bay; and (d) anchoring means, additional to said locking means for firmly anchoring the respective terminal in the respective bay.

12. A terminal supporting block as claimed in claim 11, wherein said locking blocks are provided, at normally generally upright surfaces thereof, with locking surface portions having wedge shaped longitudinally and inwardly convergent side sections and transverse, forwardly facing locking surface sections; said terminal supporting block further comprising a plurality of metallic terminals, each secured to and complementary with one of the bays and including opposed, pointed locking protrusions, the outside distance between the pointed locking protrusions being slightly in excess of a minimum transverse distance between the inwardly convergent side sections, whereby, when the metallic terminal is being inserted into the respective bay, the pointed locking protrusions are forced past the locking surface sections, the pointed locking protrusions scratch each of the respective side sections as the protrusions move along the side sections during the inserting of the terminal, so that resiliency of the material of the terminal supporting block is not required for passage of the metallic terminal past the locking sections.

13. A terminal supporting block as claimed in claim 11, wherein said anchoring means includes a normally generally upright member adapted to abut against a clamping screw threadably secured to the respective flat metallic terminal portion.

14. A terminal supporting block as claimed in claim 13, wherein said member is integral with a transverse front wall extending between the side walls and including a normally upper edge portion forming a part of said support structure.

15. A terminal supporting block as claimed in claim 14, wherein said transverse front wall is a part of a transverse structure integral with and extending between said side walls and having a generally U-shaped cross-section whose one limb is defined by a transverse rear wall generally parallel with but spaced from said end wall, said rear wall including a normally upper edge portion which forms a part of said support structure near the end wall.

16. A terminal supporting block as claimed in claim 14, wherein said transverse front wall is generally co-planar with a normally downwardly dependent, transverse rib provided with a slot-shaped passage for a winding wire from the winding to the respective bay.

17. A terminal supporting block as claimed in claim 11, wherein said locking blocks further form, near a forward opening of the bay, a normally downwardly facing surface which forms a part of said securement structure at that end of the bay which is remote from said end wall.

18. A transformer including a coil, a core and a plurality of winding wires, in combination with a terminal block assembly secured to a normally upper end of said coil and comprising, in combination, terminal block means molded from an insulating plastic material and including a plurality of terminal bays, each defined by a pair of normally upright side walls and a normally upright end wall, and a metallic terminal complementary with and mounted in each of said bays so as to be protected by the side walls against mechanical damage, wherein each bay includes:

(a) a support structure formed by members having normally upwardly facing supporting sections supporting a flat portion of the associated metallic terminal within the bay, said support structure being formed by normally upper surfaces of a pair of locking blocks integral with and disposed one on each side wall;

(b) a normally generally downwardly facing securement structure engaging normally upwardly facing portions of said terminal and co-operating with said support structure to prevent vertical displacement, within the bay, of said terminal, said securement structure being formed by an inversely and inwardly stepped portion of the end wall, said stepped portion facing a normally upper surface of the flat metallic terminal portion at a forwardmost end thereof;

(c) locking means extending inwardly of the side walls of the bay and so dimensioned with respect to the terminal, so as to provide an interference fit between the locking means and a portion of the associated metallic terminal as the latter is being inserted into the bay, to provide a temporary obstacle to the sliding of the terminal out of the bay; and (d) anchoring means additional to said locking means and firmly anchoring the terminal in the bay to prevent its withdrawal out of the bay.

19. A transformer as claimed in claim 18, wherein the anchoring means includes a normally generally upright boss abutting against a threaded stem of a clamping screw mounted in a threaded passage of the flat terminal portion.

20. A transformer as claimed in claim 19, wherein said boss is integral with a transverse front wall extending between the side walls and having a normally upper edge in contact with an underside of the flat metallic portion, near that end of the bay which is remote from said end wall.

21. A transformer as claimed in claim 20, wherein said transverse front wall is a part of a transverse structure integral with and extending between said side walls and having a generally U-shaped cross-section whose one limb is formed by the front wall, the other limb being formed by a rear transverse wall spaced from said end wall and having its normally upper edge in a supporting engagement with the underside of the flat metallic portion near the end wall.

22. A transformer as claimed in claim 20, wherein said transverse front wall is generally co-planar with a normally downwardly dependent, transverse rib provided, under each bay, with a normally downwardly open slot-shaped passage through which extends a winding wire, the end of the wire being secured to the metallic terminal.

23. A transformer as claimed in claim 18, wherein said locking blocks further form, near an entrance of the bay, a normally downwardly facing surface engaged by a cutout in a normally downwardly extending stem portion of the metallic terminal.

24. A transformer as claimed in claim 23, wherein said downwardly extending stem portion of the metallic terminal abuts against an outwardly facing surface portion of a transversely disposed front wall, while an inwardly facing surface portion of the front wall engages the threaded stem of the clamping screw of the terminal, to thus prevent longitudinal movement of the terminal along the bay.

* * * * *